United States Patent [19]

Bianchi

[11] 4,303,029

[45] Dec. 1, 1981

[54] ROTARY HOOK FOR SEWING MACHINE

[75] Inventor: Nereo Bianchi, Pavia, Italy

[73] Assignee: Necchi Societa per Azioni, Pavia, Italy

[21] Appl. No.: 69,988

[22] Filed: Aug. 27, 1979

[30] Foreign Application Priority Data

Sep. 25, 1978 [IT] Italy ..... 42913 A/78

[51] Int. Cl.[3] ..... D05B 57/26

[52] U.S. Cl. ..... 112/231

[58] Field of Search ..... 112/181, 184, 228, 229, 112/231, 232

[56] References Cited

U.S. PATENT DOCUMENTS

| | | | |
|---|---|---|---|
| 1,196,940 | 9/1916 | Finch | 112/228 X |
| 2,830,550 | 4/1958 | Attwood et al. | 112/228 X |
| 3,476,068 | 11/1969 | Preston | 112/181 |
| 4,009,670 | 3/1977 | Mitchell | 112/231 |

FOREIGN PATENT DOCUMENTS

| | | | |
|---|---|---|---|
| 398702 | 7/1924 | Fed. Rep. of Germany | 112/231 |
| 625635 | 6/1949 | United Kingdom | 112/231 |

*Primary Examiner*—Wm. Carter Reynolds

*Attorney, Agent, or Firm*—Stevens, Davis, Miller & Mosher

[57] ABSTRACT

A hook for a sewing machine comprising a hook body, a bobbin case holder arranged in the hook body, a bobbin case arranged in the bobbin case holder and a bobbin in the bobbin case. The bobbin case holder has a bottom wall from which extends a pin. The pin is provided with resilient check elements. A pin portion extends centrally from a bottom wall portion of the bobbin case defining a hole therein having a shape suitable to provide together with the pin of the bobbin case holder a locking system to lock the bobbin case to the bobbin case holder. A lever is positioned in the hole to ensure locking and release of the bobbin to and from the bobbin case. The bobbin is inserted in the bobbin case so as to close it upwardly.

3 Claims, 5 Drawing Figures

ROTARY HOOK FOR SEWING MACHINE

The present invention relates to a hook for sewing machines comprising a hook body, a bobbin case holder placed in the body containing in turn a bobbin case and a bobbin in the bobbin case. More particularly, the invention refers to new locking systems for locking the bobbin case to the bobbin case holder and the bobbin into the bobbin case and to a new relative assembling of the members.

In the standard hook of the type having a bobbin case holder, a bobbin case and a bobbin, the bobbin case containing the lower thread bobbin is positioned upside-down in the bobbin case holder showing its lower wall, so that the bobbin is completely invisible. In the standard hook the bobbin inspection and extraction are carried out by removing the bobbin case from the bobbin case holder but only after having obtained, through suitable latch means, the connection between the bobbin and bobbin case. This configuration of the hook caused two drawbacks:

the bobbin was not visible to the operator;

the bobbin case had to be provided with a rather expensive latch means to lock the bobbin.

The object to be attained by the present invention is to provide a new configuration of the hook considered as the assembly of the hook body, bobbin case holder, bobbin case and bobbin so as to eliminate the drawbacks disclosed hereinabove.

The technically realized object of the present invention is characterized in that a pin is provided on the bobbin case holder bottom wall extending from the wall which has a resilient check means suitable for coupling with a hollow portion provided in the center portion of the bobbin case, the hollow portion having a shape suitable to provide together with the pin a locking system of the bobbin case to the bobbin case holder, lever means being provided in the hollow portion to ensure locking and release of the bobbin to and from the bobbin case, the bobbin being inserted into the bobbin case in closing so that it is upwardly positioned thus resulting in being visible to the operator.

Further advantages and features will be apparent from the following description of the invention and from the enclosed drawings wherein.

Figure 1:
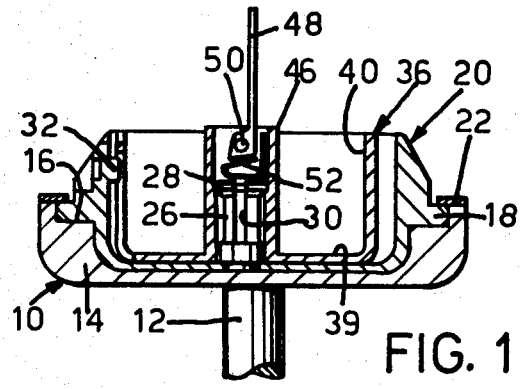
FIG. 1 shows a cutaway view of the entire hook of the present invention.

Referring to FIG. 1 numeral 10 is a sewing machine rotary hook comprising shaft 12, a cup-shaped hook body 14 having inside thereof a raceway 16 on which lays bearing rib 18 of bobbin case holder 20. A holder ring 22, fixed in a known way to the hook body 14, overhangs the upper portion of the bobbin case holder bearing rib 18 to hold it inside hook body 14. A hollow pin 26 rises from the bottom wall 24 (FIG. 5) of the bobbin case holder 20. According to the present invention pin 26 has an uppper portion 28 of greater diameter than the remainder of the pin. Pin 26 has four slits 30 placed symmetrically on the circumference and extending longitudinally for a large portion of the entire length of the pin 26 from the upper portion 28 to the bottom wall 24 of bobbin case holder 20. On the inner side wall

Figure 2:
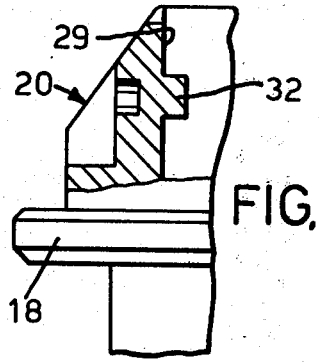
FIGS. 2 and 3 show two magnified views of members of the hook of FIG. 1.
Figure 3:
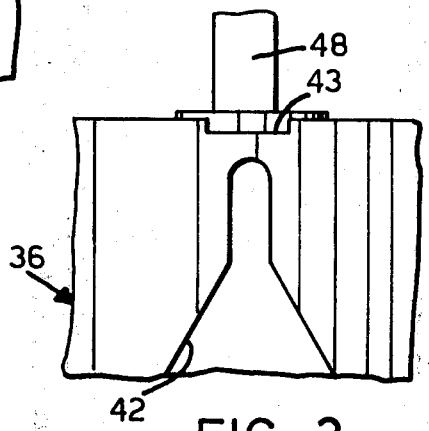
Figure 4:
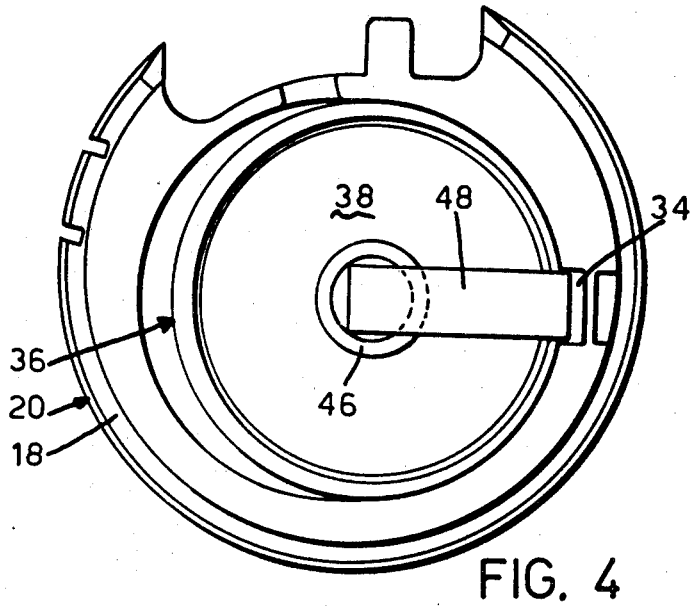
FIG. 4 shows a plan view of the hook of FIG. 1.

29 (FIG. 2 of bobbin case holder 20 there is moreover provided a tooth 32 acting as a fiducial mark (FIGS. 1 and 2). In the upper portion of the wall 29 (FIG. 4) over tooth 32 a notch 34 is made on the circumference. The function of element 20 will be described hereinafter. A bobbin case 36 containing bobbin 38 (FIG. 4) is provided inside the bobbin case holder 20. Bobbin case 36 has the standard shape of a cylindrical container provided with a bottom wall 39 and a side wall 40. On the side wall 40 there is placed the usual bobbin thread tension device (not shown in the drawings) and a notching 42 having the shape shown in FIG. 3, suitable for engaging tooth 32 provided onto bobbin case holder side wall 29. In this way there is only one possible coupling between bobbin case 36 and bobbin case holder 20 in a well-determined relative position between the members.

Extending from the bottom wall 39 of bobbin case 36 is a pin 46 defining a hole 44 therein extending centrally of the pin through the bottom wall 39 of the bobbin case 36.

The upper portion of the side wall of bobbin case 36 defines a circumferential notch 43 over notching 42. In the upper portion of the hollow pin 46 a lever plate 48 is mounted pivoted at one end to a pin 50. A spring 52 fixed inside pin 46 functions to urge the lever plate 48 to two equilibrium positions. In the first equilibrium position (FIGS. 3 and 5) lever plate 48 is placed vertically as an extension of pin 46. In the second equilibrium position (FIG. 4) it is arranged to have its free end rest in the suitable notches 43 and 34 positioned on the upper walls of the bobbin case 36 and the bobbin case holder 20, respectively.

Figure 5:
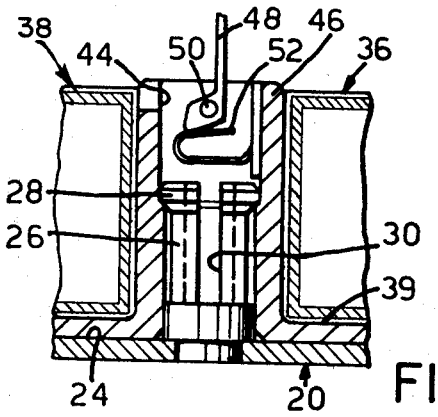
FIG. 5 is a sectional view of the locking system of two members of the hook of FIG. 1.

Hole 44 of bobbin case 36 has, as shown in FIG. 5, two different diameters the smaller one in the lower portion. When bobbin case 36 is to be inserted into the bobbin case holder 20, lever plate 48 is moved to its raised position so as to catch it by the fingers introducing bobbin case 36 in the bobbin case holder 20 causing hole 44 to couple with pin 26. Thanks to its shaping, pin 26 shrinks resiliently in correspondence with the smallest diameter of hole 44 and expands as the hole diameter becomes wider in such a way as to ensure sealing between bobbin case 36 and bobbin case holder 20.

The lever plate 48 is then lowered causing its free end to rest within notches 34 and 43 so as not to become an obstacle to the loop thread slipping onto the upper portion of the bobbin case holder 20. By this way locking between bobbin case 36 and bobbin case holder 20 there is reached also through lever plate 48 the locking of bobbin 38 inside bobbin case 36.

What is claimed is:

1. A hook for a sewing machine comprising a hook body, a bobbin case holder arranged in said hook body, a bobbin case arranged in said bobbin case holder, a bobbin in said bobbin case, said bobbin case holder having a bottom wall from which extends a pin, said pin defining an upper portion of greater diameter than the remainder of the pin and having slits therein extending longitudinally for a large portion of the length of the pin, a hollow pin extending centrally from a bottom wall portion of said bobbin case defining a hole therein having two different diameters suitable to provide together with said pin of said bobbin case holder a locking system to lock said bobbin case to the said bobbin case holder, and lever means positioned in said hole to ensure locking of said bobbin in the bobbin case during sewing and to facilitate removal and insertion of the bobbin case from and in the bobbin case holder when bobbin change is requested.

2. The hook according to claim 1 wherein said bobbin case holder has a side wall defining a tooth on the inner side of said side wall and said bobbin case has a side wall defining a notching, said tooth being made suitable to couple with said notching to ensure assembling of the said members in one only predetermined relative position.

3. The hook according to claim 1 including a spring positioned centrally in the top of said hole in said bobbin case, said spring being shaped to urge said lever means defining a check lever plate of said bobbin to two equilibrium positions, the first of which is vertical to allow assembling of the bobbin in the bobbin case and seizing of the same by the operator, and the second of which is laying in contact with said bobbin to ensure maintaining said bobbin within said bobbin case.

* * * * *